US009827166B2

(12) United States Patent
Evans

(10) Patent No.: US 9,827,166 B2
(45) Date of Patent: Nov. 28, 2017

(54) PILL CRUSHING DEVICE FOR PULVERIZING PILLS AND MINIMIZING TRANSFER LOSS OF PULVERIZED PILLS

(71) Applicant: Ann Evans, Stow, OH (US)

(72) Inventor: Ann Evans, Stow, OH (US)

( * ) Notice: Subject to any disclaimer, the term of this patent is extended or adjusted under 35 U.S.C. 154(b) by 0 days.

(21) Appl. No.: 15/133,615

(22) Filed: Apr. 20, 2016

(65) Prior Publication Data

US 2016/0310366 A1 Oct. 27, 2016

Related U.S. Application Data

(60) Provisional application No. 62/151,144, filed on Apr. 22, 2015.

(51) Int. Cl.
*A61J 7/00* (2006.01)

(52) U.S. Cl.
CPC ..... *A61J 7/0007* (2013.01); *A61J 7/0023* (2013.01)

(58) Field of Classification Search
CPC ..... A61J 7/0007; A61J 7/0023; A61J 1/03; Y10S 241/27
See application file for complete search history.

(56) References Cited

U.S. PATENT DOCUMENTS

| | | | | |
|---|---|---|---|---|
| 6,347,727 | B1 * | 2/2002 | Diaz | A61J 7/0023 222/101 |
| 6,637,683 | B1 * | 10/2003 | (Lomax) Wilbur | A61J 7/0007 241/101.2 |
| 7,975,943 | B1 * | 7/2011 | Culves | A61J 7/0007 241/69 |
| 2014/0217221 | A1 * | 8/2014 | Hohl | A61J 7/0007 241/285.1 |

* cited by examiner

*Primary Examiner* — R. K. Arundale
*Assistant Examiner* — Joseph Finan, Jr.
(74) *Attorney, Agent, or Firm* — Rankin, Hill & Clark LLP

(57) ABSTRACT

A pill crushing device pulverizes pills and then transfers the pulverized pills out of the device with minimal transfer loss and spillage. The device includes a storage portion and a pill chamber. The pill chamber forms a threaded connection with the storage portion that enables detachment. The storage portion stores the pill and operates the crushing mechanism. The pill is pulverized in the pill chamber. The pill chamber is disposed beneath the storage portion. A first spoon retains the pill and carries the pulverized pill out of the chamber along a longitudinal opening of the pill chamber. An optional second spoon detachably attaches to the first spoon to carry supplemental compositions to the pulverized pill.

14 Claims, 9 Drawing Sheets

PILL CRUSHING DEVICE FOR PULVERIZING PILLS AND MINIMIZING TRANSFER LOSS OF PULVERIZED PILLS

CROSS REFERENCE TO RELATED APPLICATIONS

This application is based upon, and claims priority to U.S. Provisional Application No. 62/151,144 filed 22 Apr. 2015, which is hereby incorporated by reference in its entirety.

FIELD OF THE INVENTION

The present invention relates generally to a pill crushing device for pulverizing pills and minimizing transfer loss and spillage of the pulverized pills.

SUMMARY OF THE INVENTION

A pill crushing device provides a first spoon that serves as a supportive base in a pill chamber for pulverizing a pill, and then carries the pulverized pill from the pill chamber with minimal transfer loss and spillage. The invention optionally provides a second spoon that works in conjunction with the first spoon to further minimize transfer loss of the pulverized pill.

BRIEF DESCRIPTION OF THE DRAWINGS

The invention will now be described, by way of example, with reference to the accompanying drawings, in which:

FIG. 8A illustrates a perspective view of an exemplary first spoon, FIG. 8B illustrates a sectioned side view of the first spoon, and FIG. 8C illustrates the section taken along section A-A of FIG. 8B, detailing the first spoon, in accordance with an embodiment of the present invention.

Like reference numerals refer to like parts throughout the various views of the drawings.

DETAILED DESCRIPTION OF THE INVENTION

Figure 1A:
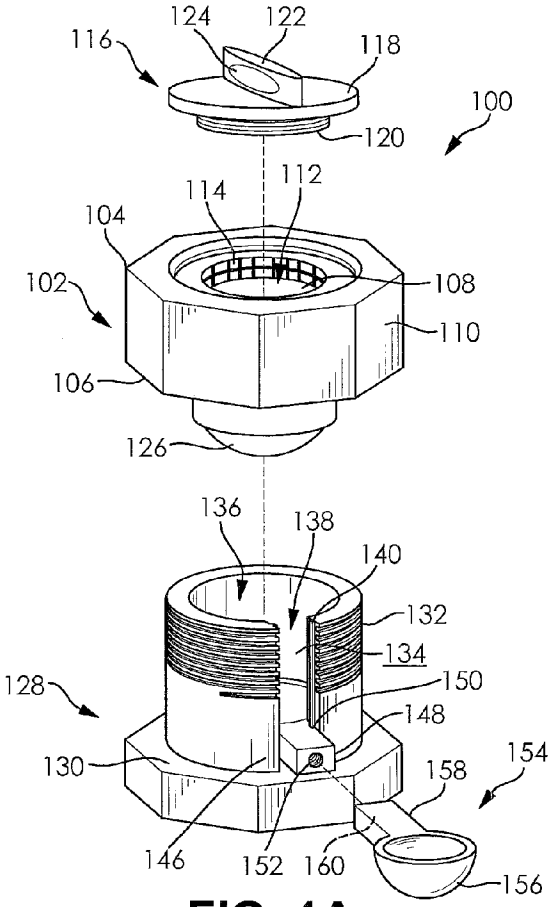
FIG. 1A illustrates a perspective frontal view of an exemplary pill crushing device, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C, §112.

In one embodiment of the present invention presented in FIGS. 1-11C, a pill crushing device 100 provides a multi-purpose medicinal administration tool that is efficacious for facilitating the preparation and administration of pills with minimal transfer loss and spillage. The pill crushing device 100, hereafter "device 100", provides a hand operated pill crusher that pulverizes a pill, and then transfers the pulverized pill for administration with minimal transfer loss or spillage.

Figure 1:
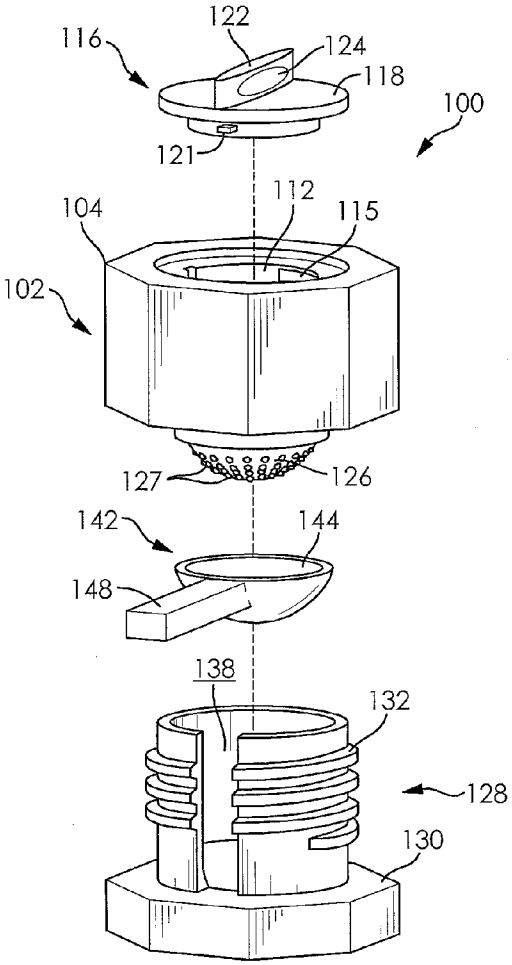
FIG. 1 illustrates a perspective frontal view of an exemplary pill crushing device, in accordance with an embodiment of the present invention.

As referenced in FIG. 1, device 100 comprises a storage portion 102 and a generally C-shaped pill chamber 128. Storage portion 102 is arranged to detachably attach to pill chamber 128. Pill chamber 128 forms a threaded connection with storage portion 102 that enables detachment and also creates the rotatable pulverizing means for device 100. Storage portion 102 is generally used to store the pill and actuate the crushing mechanism. Pill chamber 128 is generally where the pill is crushed. Thus, pill chamber 128 is disposed beneath storage portion 102, such that applied rotatable pressure and weight is maximized.

Figure 2A:
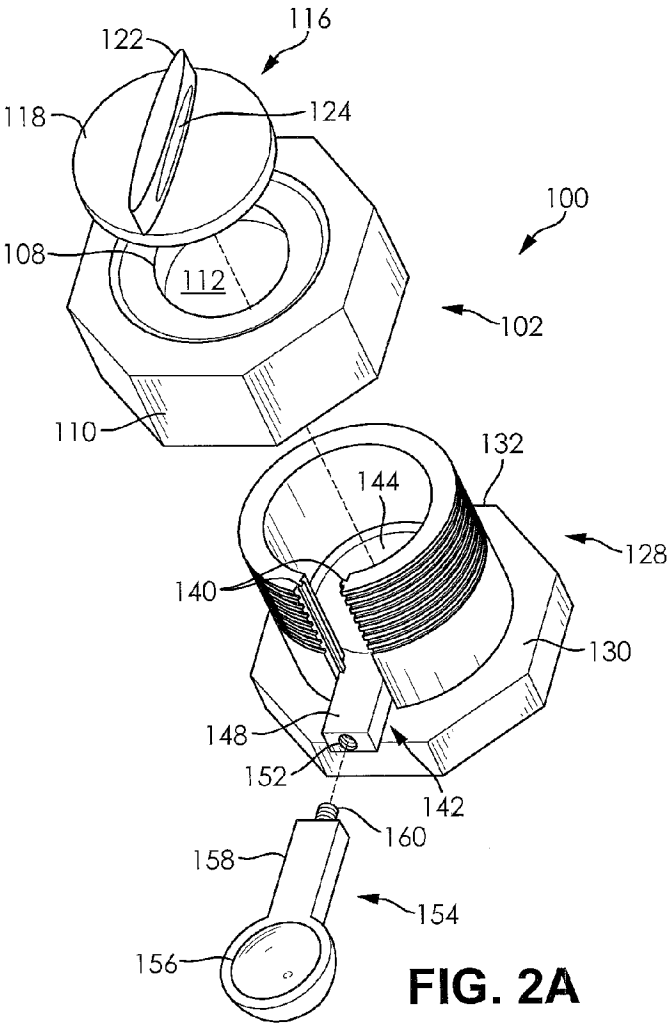
FIG. 2A illustrates a perspective top angle view of the pill crushing device, in accordance with an embodiment of the present invention.
Figure 2:
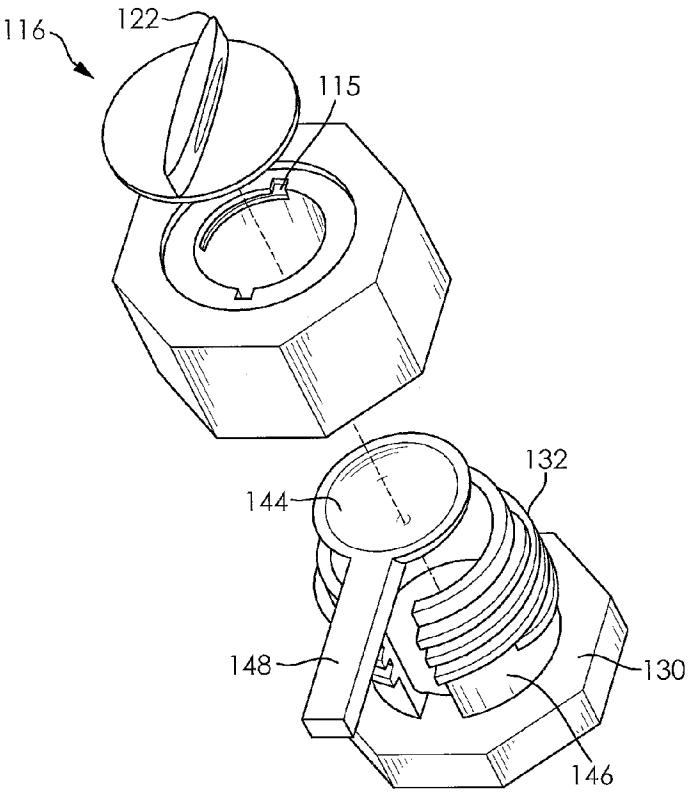
FIG. 2 illustrates a perspective top angle view of the pill crushing device, in accordance with an embodiment of the present invention.

Turning now to FIGS. 1, 1A, 2 and 2A, a first spoon 142 in pill chamber 128 retains the pills and steadily carries the pulverized pill out of the chamber along a longitudinal opening 138 in the peripheral sidewalls of the pill chamber 128. In FIGS. 1A and 2A a second spoon 154 detachably attaches to first spoon 142 to carry and add supplemental compositions to the pulverized pills in the first spoon 142.

Figure 10A:
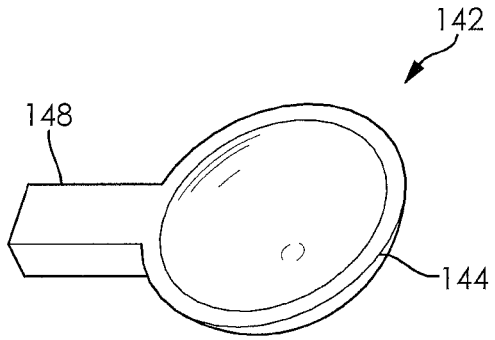
FIG. 10A illustrates a perspective view of an exemplary first spoon.
Figure 10B:
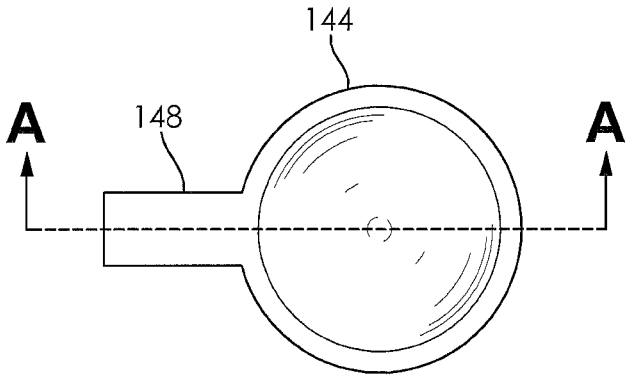
FIG. 10B illustrates a sectioned side view of the first spoon.
Figure 10C:
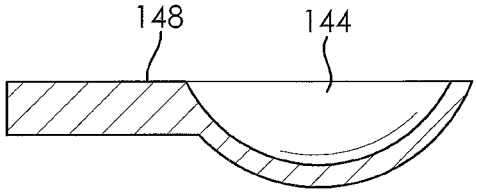
FIG. 10C illustrates the section taken along section A-A of FIG. 10B, detailing the first spoon, in accordance with an embodiment of the present invention.

First spoon 142 serves to retain the pill in pill chamber 128 while pulverizing the pills. First spoon 142 is also configured to steadily ride along a longitudinal opening 138 in pill chamber 128 to carry the crushed pills out of pill chamber 128 with minimal transfer loss and spillage. Lateral and oscillating motions are minimized due to a snug tongue 140 and slot 150 relationship between first spoon 142 and longitudinal opening 138; and a brace 146 on the first spoon 142 that presses against an inner chamber sidewall 134 of pill chamber 128 during transfer. The pulverized pill may then be administered directly from first spoon 142. However as seen in FIGS. 10A-10C, the slot 150 is optional (and not present in these embodiments).

As shown in FIGS. 6A, and 11A-11C an optional second spoon 154 detachably attaches to first spoon 142, and works in conjunction with the first spoon 142 to enhance the crushed pill by carrying supplementary compositions and foods to be mixed with the pulverized pill. The supplementary compositions and foods may include, without limitation, apple sauce, honey, sugar, and spices as well as any food or liquid that can be taken together to make a medicine go down in a most delightful way. Optional second spoon 154 also serves to further elongate a first handle 148 of first spoon 142.

In one aspect, the pill crushing device 100 for pulverizing pills and minimizing transfer loss of pulverized pills comprises:

a storage portion 102, the storage portion 102 defined by a lid end 104, a pulverizing end 106, a threaded inner sidewall 108, an outer sidewall 110 (that is optionally textured), a threaded storage opening 114, and a storage cavity 112;

a lid 116, the lid 116 defined by a panel 118, a connector which may be slot-and-tab connector 115 or optionally threaded connector 120, and a lid handle 122. The lid handle 122 may, but need not, include a depression 124, or other feature to assist gripping of the handle 122.

The lid 116 attaches to the lid end 104 of the storage portion 102 by rotation of the tab connector 121 (or threaded connector 120) against slot opening 115 (or threaded storage opening 114) in a first direction, wherein the lid 116 detaches from the lid end 104 of the storage portion 102 by rotation of the tab connector 121 (or of the threaded connector 120) against slot opening 115 (or threaded storage opening 114) in a second direction;

a crushing member 126, the crushing member 126 disposed to protrude from the pulverizing end 106 of the storage portion 102;

a generally C-shaped pill chamber 128, the pill chamber 128 defined by a platform 130, a threaded outer chamber sidewall 132, an inner chamber sidewall 134, a pill cavity 136, and a longitudinal opening 138, the longitudinal opening 138 optionally comprising a tongue 140, wherein the crushing member 126 is displaced into the pill cavity 136 of the pill chamber 128 by rotation of the threaded inner sidewall 108 against the threaded outer chamber sidewall 132 in the first direction, wherein the crushing member 126 is displaced out of the pill cavity 136 by rotation of the threaded inner sidewall 108 against the threaded outer chamber sidewall 132 in the second direction;

a first spoon 142, the first spoon 142 configured to slidably move along the longitudinal opening 138 for detachment from the pill chamber 128, the first spoon 142 defined by a first head 144 and an elongate first handle 148, the first head 144 oriented generally towards the pill cavity 136, the first handle 148 oriented generally towards the outside of the chamber cavity, the first head 144 comprising a brace 146, the brace 146 configured to press against the inner chamber sidewall 134 of the pill chamber 128, the first handle 148 optionally comprising a pair of optional slots 150 and an optional first fastening junction 152 (to be used, for example, in conjunction with optional second spoon 154, noted hereinbelow), the pair of slots 150 configured to mate with the optional tongue 140 of the longitudinal opening 138, wherein the relationship between the brace 146 and the inner chamber sidewall 134 helps minimize lateral and oscillating motions by the first spoon 142 during movement along the longitudinal opening 138, wherein the relationship between optional the pair of slots 150 and the optional tongue 140 helps minimize lateral and oscillating motions by the first spoon 142 during movement along the longitudinal opening 138.

In an alternate embodiment, the pill crushing device 100 further comprises a second spoon 154, the second spoon 154 defined by a second head 156 and an elongate second handle 158, the second handle 158 terminating at a second fastening junction 160, the second fastening junction 160 configured to detachably couple to the first fastening junction 152 of the handle 148.

In a second aspect, the storage portion 102 has a generally octagonal shape in cross section. Other cross sectional shapes such as circular, triangular, square, pentagonal, hexagonal and various polygons are also envisioned (and not pictured).

In another aspect, when outer sidewall 110 is optionally textured, it is defined by a pattern of textures configured to enhance grip of the storage portion 102.

In another aspect, the pattern of textures are piano shaped gripping lines. Other texture patterns including dimples and indentations; cross hatching, cross drilling and a roughened surface such as sandpaper or other abrasive are envisioned. In a preferred embodiment, there are no textures and the gripping surfaces are smooth.

In another aspect, the lid 116 has a generally circular shape.

In another aspect, the crushing member 126 has a generally spherical shape, however parabolic or hyperbolic shapes are also envisioned. Crushing member 126 may optionally include at least one protrusion 127 to assist in crushing a tablet or pill.

In another aspect, the first spoon 142 is configured to receive a pill while in the pill cavity 136.

In another aspect, the first spoon 142 is configured to provide a base for the pill while the pill is pulverized by the crushing member 126.

In another aspect, the first spoon 142 is configured to administer the pill while detached from the pill chamber 128.

In another aspect, the optional second spoon 154 is configured to receive a supplemental composition or food for adding to the pulverized pill.

In another aspect, the platform 130 has a generally octagonal shape. Other shapes such as circular, square, hexagonal and various polygons are also envisioned (and not pictured). In another aspect, the platform 130 is defined by a pattern of textures (not shown) configured to enhance grip of the pill chamber 128.

In another aspect, the first fastening junction 152 is a threaded opening.

In another aspect, the second fastening junction 160 is a threaded protrusion, the threaded protrusion configured to rotatably couple to the threaded opening of the first handle 148.

One objective of the present invention is to provide a pill crushing device 100 that has a first spoon 142 for receiving a pill.

Another objective is to provide a first spoon 142 for supporting the pill while the pill is being pulverized.

Another objective is to provide a first spoon 142 for disengaging from the pill chamber 128 with minimal transfer loss or spillage.

Another objective is to provide a snug engagement between the brace 146 and the inner chamber sidewall 134 to minimize lateral and oscillating motions by the first spoon 142 during movement along the longitudinal opening 138.

Another objective optionally is to provide a snug engagement between the pair of optional slots 150 and the optional tongue 140 to minimize lateral and oscillating motions by the first spoon 142 during movement along the longitudinal opening 138.

Another objective is to provide a crushing member 126 that pulverizes the pill through a manual, rotatable mechanism.

Optionally, the invention provides a second spoon 154 that detachably attaches to the first spoon 142.

Optionally, the invention provides a second spoon 154 that may be used to transport a food or liquid to be consumed together with the pulverized pills.

Optionally, the invention provides piano shaped grips on the textured outer sidewall 110 of the storage portion 102 to enhance the grip when rotating the lid 116 against the storage portion 102. Other grip texture patterns including dimples and indentations; cross hatching, cross drilling and a roughened surface such as sandpaper or other abrasive are envisioned.

Optionally, the invention provides piano shaped grips on the platform 130 of the storage portion 102 to enhance the grip when rotating the storage portion 102 against the pill chamber 128. Other grip texture patterns including dimples and indentations; cross hatching, cross drilling and a roughened surface such as sandpaper or other abrasive are envisioned.

Another objective is to provide a pill crushing device 100 that is inexpensive to manufacture and easy to operate.

Another objective it a method of crushing a pill or tablet including operation of the device pill crushing device 100 by displacing the crushing member 126 into the pill cavity 136 of the pill chamber 128 by rotation of the threaded inner side wall 108 against the threaded outer chamber 132.

Figure 3A:
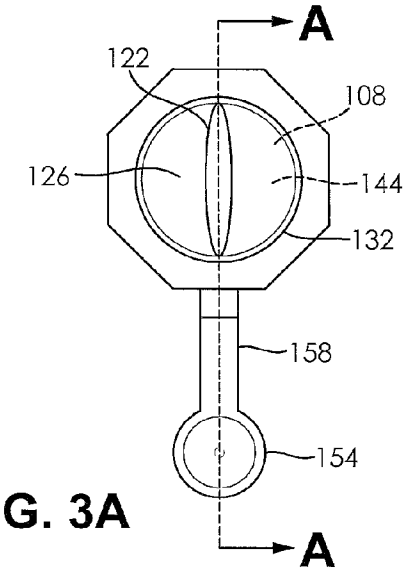
FIG. 3A illustrates a sectioned top view of the pill crushing device.
Figure 4A:
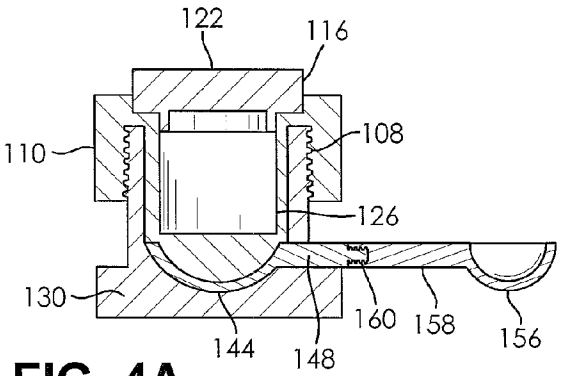
FIG. 4A illustrates the section taken along section A-A of FIG. 3A, detailing the pill crushing device, in accordance with an embodiment of the present invention.
Figure 3:
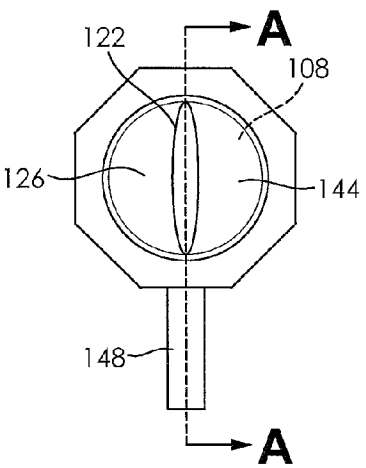
FIG. 3 illustrates a sectioned top view of the pill crushing device.
Figure 4:
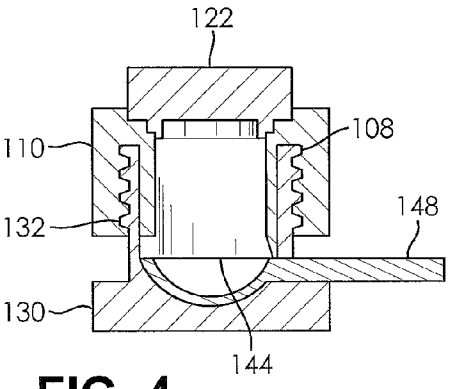
FIG. 4 illustrates the section taken along section A-A of FIG. 3, detailing the pill crushing device, in accordance with an embodiment of the present invention
Figure 5A:
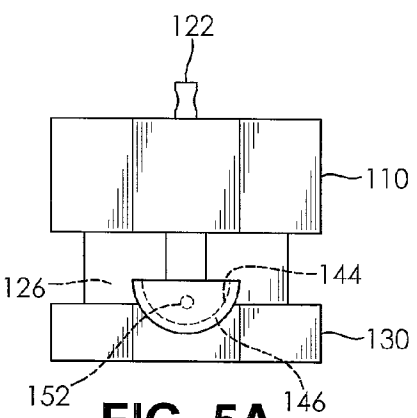
FIG. 5A illustrates a frontal view of the pill crushing device, in accordance with an embodiment of the present invention.
Figure 5:
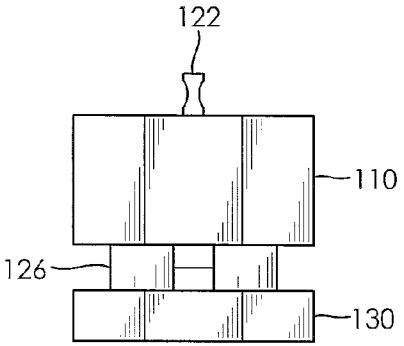
FIG. 5 illustrates a frontal view of the pill crushing device, in accordance with an embodiment of the present invention.

As illustrated in FIGS. 3A and 3B, device 100 comprises a storage portion 102 and a generally C-shaped pill chamber 128. In one aspect, "C-shaped" can mean generally cylindrical with a longitudinal opening 138 cut out. Storage portion 102 is arranged to detachably attach to pill chamber 128. Pill chamber 128 forms a threaded connection with storage portion 102 that enables detachment and also creates the rotatable pulverizing means for device 100. Storage portion 102 is generally used to store the pill and actuate the crushing and pulverizing mechanism. Pill chamber 128 is generally where the pill is pulverized and stored until administered. Thus, pill chamber 128 is disposed beneath the storage portion 102, such that applied rotatable pressure is maximized (FIGS. 4 and 5). Suitable materials for storage portion 102 and pill chamber 128 may include, without limitation, a thermoplastic polymer, a rubber, polyurethane, polyvinyl chloride, a metal, glass, ceramic, and wood.

Figure 6A:
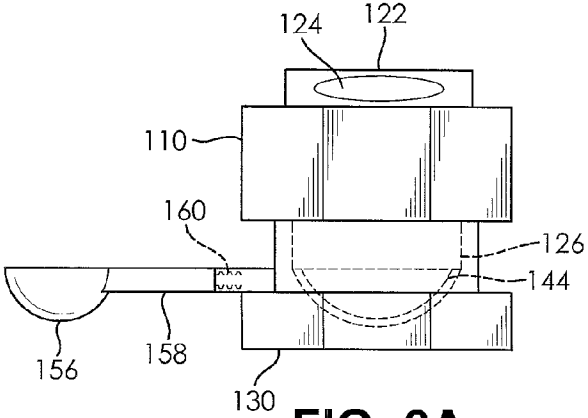
FIG. 6A illustrates an elevated side view of the pill crushing device, in accordance with an embodiment of the present invention.
Figure 6:
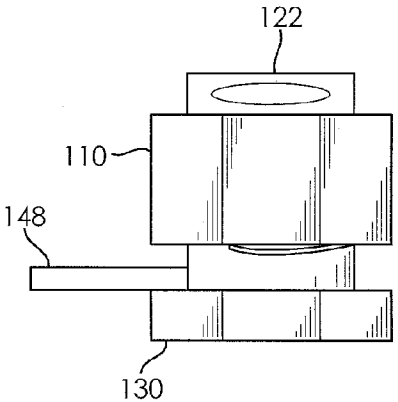
FIG. 6 illustrates an elevated side view of the pill crushing device, in accordance with an alternate embodiment of the present invention.

As shown in FIGS. 6A and 6B, storage portion 102 is defined by a lid end 104, a pulverizing end 106, a threaded inner sidewall 108, an outer sidewall 110 that is optionally textured, and a threaded storage opening 114. Storage portion 102 further includes a storage cavity 112 that is shaped and dimensioned to receive a pill. A detachably attached lid 116 on the lid end 104 of the storage portion 102 provides access to the storage cavity 112. The lid 116 comprises a panel 118, a threaded connector 120, and a lid handle 122 having a depression 124. The lid handle 122 extends from the panel 118 to enable rotational manipulation of the lid 116. Depression 124 is disposed in lid handle 122 to receive a digit, such as a thumb, for facilitating gripping of lid 116 while rotating and detaching lid 116.

Storage cavity 112 is accessed by rotatably removing lid 116 from lid end 104. In one embodiment, lid 116 attaches to lid end 104 of storage portion 102 by rotation of a tab connector 121 against slotted connecting channel 115. In this embodiment, conversely, lid 116 detaches from lid end 104 of storage portion 102 by rotation of a tab connector 121 against slotted connecting channel 115 in a second direction.

In another embodiment, lid 116 attaches to lid end 104 of storage portion 102 by rotation of threaded connector 120 against threaded storage opening 114 in a first direction. Conversely, lid 116 detaches from lid end 104 of storage portion 102 by rotation of threaded connector 120 against threaded storage opening 114 in a second direction. In the embodiment of this or the preceding paragraph, when lid 116 is detached, the pill may be removed from storage portion 102 for pulverizing. In one embodiment, lid 116 forms an air tight seal with the threaded storage opening 114 to maintain freshness of the pill.

Looking now at FIGS. 7A-7D, storage portion 102 further includes a crushing member 126 that protrudes from pulverizing end 106 of the storage portion. Crushing member 126 forcibly and rotatably engages the pills during the pulverizing process. Crushing member 126 may take a generally spherical shape that maximizes surface area contact with the pill. Crushing member 126 may optionally include dimples 127 (best seen in FIG. 1) to increase pulverizing force. Outer sidewall 110 (optionally textured) of storage portion 102 enables rotation of storage portion 102 with minimal slippage.

Figure 8A:
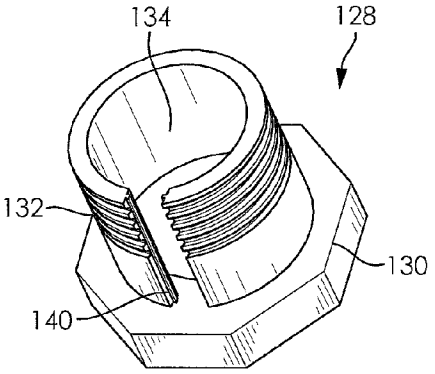
FIG. 8A illustrates a perspective view of an exemplary pill chamber.
Figure 8B:
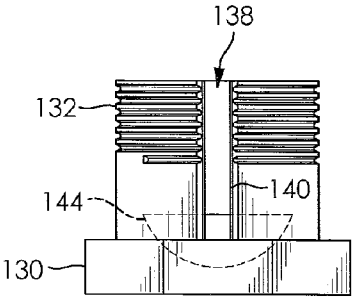
FIG. 8B illustrates an elevated side view of the pill chamber.
Figure 8C:
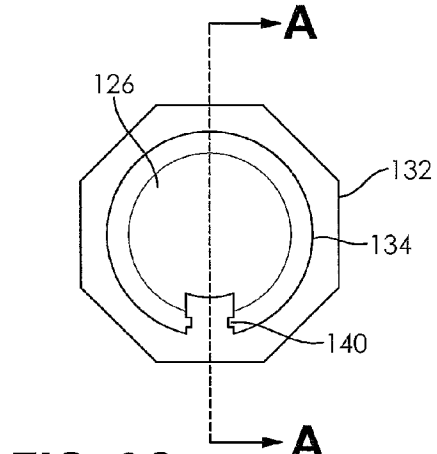
FIG. 8C illustrates a sectioned side view of the pill chamber.

As referenced in FIGS. 8A and 8B, device 100 further comprises a generally C-shaped pill chamber 128. Pill chamber 128 is defined by a platform 130, a threaded outer chamber sidewall 132, an inner chamber sidewall 134, a pill cavity 136, and a longitudinal opening 138. Platform 130 of pill chamber 128 supports the weight of device 100 while pulverizing the pill. The pill cavity 136 is chiefly where the pill is pulverized. The longitudinal opening 138 provides a path for carrying the crushed pills out of pill cavity 136, such that there is minimal loss of transfer or spillage of the crushed pills. The longitudinal opening 138 comprises a tongue 140 that extends along the length of the longitudinal opening 138 (FIG. 8B). Tongue 140 is configured to help maintain the stability during transfer. In certain embodiments, tongue 140 is absent.

Figure 8D:
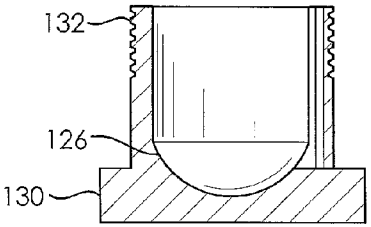
FIG. 8D illustrates the section taken along section A-A of FIG. 8C, detailing the pill chamber, in accordance with an embodiment of the present invention.

Crushing member 126 rotates in relation to pill chamber 128 to pulverize the pill. In one embodiment, storage portion 102 is gripped at textured outer sidewall 110, and then rotated to thread into pill chamber 128 and to drive crushing member 126 into pill chamber 128 for crushing the pill. Thus, crushing member 126 is displaced into the pill cavity 136 of pill chamber 128 by rotation of threaded inner sidewall 108 against threaded outer chamber sidewall 132 in the first direction (FIG. 8D). In this disposition, the pill is pulverized by the force and weight of crushing member 126. Conversely, crushing member 126 is displaced out of pill cavity 136 by rotation of the threaded inner sidewall 108 against threaded outer chamber sidewall 132 in the second direction.

Referencing FIGS. 9A-9C and 10A-10C, device 100 utilizes a first spoon 142 to support the pulverizing means inside pill chamber 128. First spoon 142 also carries the pulverized pill out of the pill chamber 128 in a steady disposition along longitudinal opening 138. First spoon 142 is also used to administer the pulverized pill. First spoon 142 is defined by a first head 144 and an elongate first handle 148. First head 144 is oriented generally towards the chamber cavity, while elongate first handle 148, at least partially, extends out through longitudinal opening 138.

First head 144 provides both a surface for direct administration of the pulverized pill, and a supportive and removable base inside pill chamber 128. First head 144 is concave shaped so as to receive the pill for crushing, and then feed the pulverized pill into a mouth. A brace 146 forms beneath first head 144. Brace 146 is configured to press against the inner chamber sidewall 134 of pill chamber 128 while slidably engaging the longitudinal opening 138 of pill chamber 128 so as to increase stability while first spoon 142 rides up and down longitudinal opening 138. In one embodiment, brace 146 forms a generally U-shape that contours the curved surface of inner chamber sidewall 134.

Figure 9A:
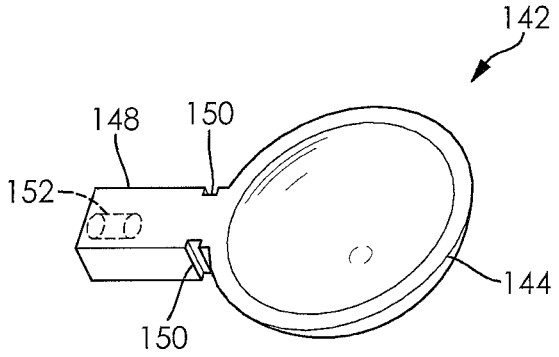
FIG. 9A illustrates a perspective view of an exemplary first spoon.
Figure 9B:
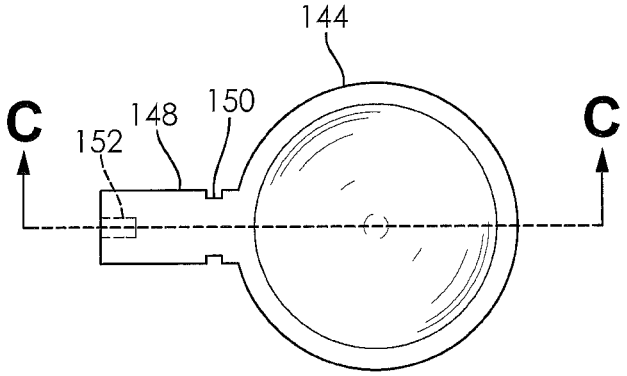
FIG. 9B illustrates a sectioned side view of the first spoon.

As shown in FIG. 9B, elongate first handle 148 extends generally perpendicular from longitudinal opening 138 of pill chamber 128. A pair of optional slots 150 form on opposite lateral sides of first handle 148. Optional slots 150 catch the optional tongue from longitudinal opening 138, forming a snug interaction therebetween. Because of the slidable interaction between optional tongue 140 and optional slots 150, the first handle slides up and down along the length of pill chamber 128 with minimal lateral sway or tilting. This relatively smooth slidable movement enables first spoon 142 to carry the pulverized pill out of the cavity with minimal transfer loss and spillage. Thus, the relationship between brace 146 and inner chamber sidewall 134, and also the pair of slots and the tongue helps minimize lateral and oscillating motions by first spoon 142 during movement along longitudinal opening 138.

Figure 9C:
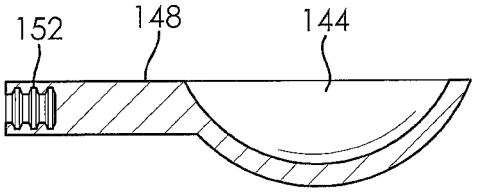
FIG. 9C illustrates the section taken along section A-A. of FIG. 9B, detailing the first spoon, in accordance with an embodiment of the present invention.

As illustrated in FIG. 9C, first handle 148 may (but need not) terminate at a first fastening junction 152. Optional first fastening junction 152 may include a threaded opening. However, in other embodiments, optional first fastening junction 152 may be selected from a threaded protrusion, a magnet, a screw, and an adhesive.

FIGS. 10A-10C depict the embodiment of FIGS. 9A-9C lacking slots 150 and fastening junction 152.

Figure 11A:
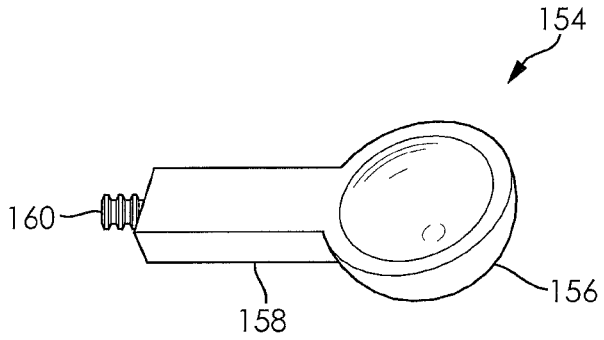
FIG. 11A illustrates a perspective view of an exemplary optional second spoon.

Turning now to FIG. 11A, device 100 optionally further comprises a second spoon 154 that detachably attaches to first spoon 142. It is noted that the preferred embodiment of the invention does not include second spoon 154, though such is not excluded from the scope of the invention. Second spoon 154 is defined by a second head 156 having a generally concave shape, similar to the first head 144. However, in some embodiments, second head 156 is smaller than first head 144. Second head 156 is configured to receive and carry supplements, compositions, and/or food to add to the crushed pills.

Figure 11B:
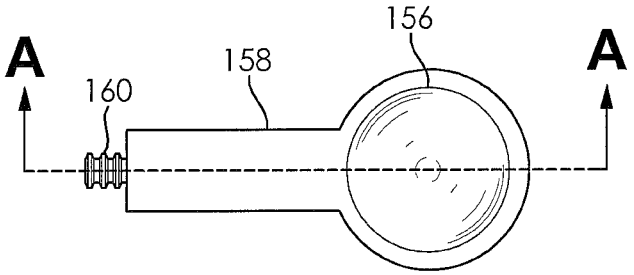
FIG. 11B illustrates a sectioned side view of the optional second spoon.
Figure 11C:
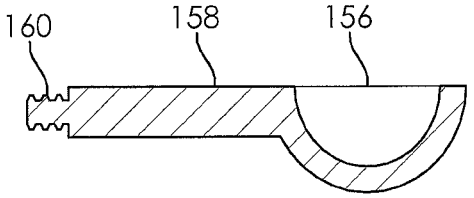
FIG. 11C illustrates the section taken along section A-A of FIG. 11B, detailing the optional second spoon, in accordance with an embodiment of the present invention.

As shown in FIGS. 11B and 11C, second head 156 further includes an elongate second handle 158. Second handle 158 terminates at a second fastening junction 160. Second fastening junction 160 is configured to couple to first fastening junction 152 of the first handle through a threaded protrusion, or other fastening means known in the art. In this manner, the first and second spoons 142, 154 detachably attach at their respective handles 148, 158.

In operation, the pill is stored in storage cavity 112 of storage portion 102. Lid 116 is rotatably removed by rotating lid handle 122 in the first direction. The threaded connector 120 on lid 116 rotatably engages threaded storage opening 114 of storage portion 102. Once lid 116 is removed, the pill is removed and transferred into pill cavity 136, resting on first head 144 of first spoon 142. Outer sidewall 110 of storage portion 102 is rotated in the first direction to displace crushing member 126 into the pill cavity 136 of pill chamber 128. The displacement of crushing member 126 is operable by rotation of threaded inner sidewall 108 of storage portion 102 against threaded outer chamber sidewall 132 of pill chamber 128 in the first direction. In this disposition, the pill is pulverized by the force and weight of crushing member 126.

Figure 7A:
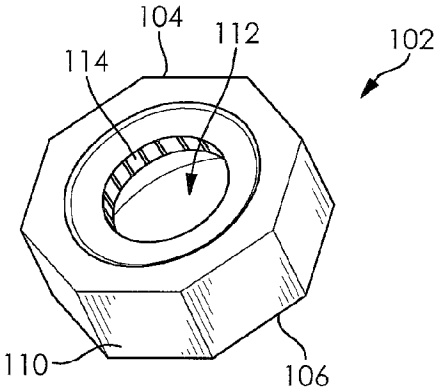
FIG. 7A illustrates a perspective view of an exemplary storage portion and an exemplary lid.
Figure 7B:
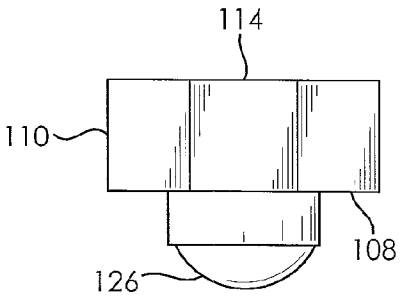
FIG. 7B illustrates an elevated side view of the storage portion and the lid.
Figure 7C:
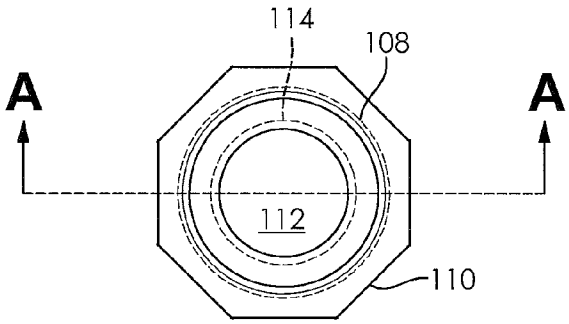
FIG. 7C illustrates a sectioned side view of the storage portion.
Figure 7D:
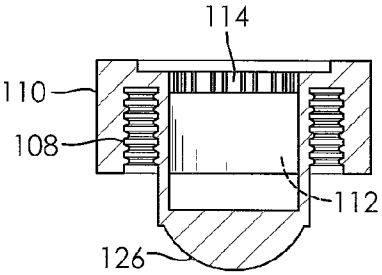
FIG. 7D illustrates the section taken along section A-A of FIG. 7C, detailing the storage portion, in accordance with an embodiment of the present invention; the embodiment of FIGS. 7A-7D relates to that of FIGS. 1A and 2A.

Once the pill is pulverized, first spoon 142 slidably moves up longitudinal opening 138 to detach from pill chamber 128. The brace 146 is sized and dimensioned to press against inner chamber sidewall 134 during this slidable movement of first spoon 142. Additionally, the optional pair of slots 150 on the lateral sides of first handle 148 form a snug mating arrangement with tongue 140 on longitudinal opening 138 (FIG. 7A). The relationship between brace 146 and inner chamber sidewall 134, and also the optional pair of slots 150 and tongue 140 helps minimize lateral and oscillating motions by first spoon 142 during movement along the longitudinal opening 138. In some embodiments, second spoon 154 rotatably detaches from the first spoon 142 at the respective fastening junctions 152, 160. Second head 156 may then receive and add a composition, food, or liquid to the pulverized pill for enhancement.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

The invention claimed is:

1. A pill crushing device comprising:

a storage portion, the storage portion defined by a lid end, a pulverizing end, a threaded inner sidewall, an outer sidewall, a threaded or slotted storage opening, and a storage cavity;

a lid, the lid defined by a panel, a threaded or slotted connector, and a lid handle;

wherein the lid attaches to the lid end of the storage portion by rotation of the threaded or slotted connector against the threaded or slotted storage opening in a first direction, wherein the lid detaches from the lid end of the storage portion by rotation of the threaded or slotted connector against the threaded or slotted storage opening in a second direction;

a crushing member, the crushing member disposed to protrude from the pulverizing end of the storage portion;

a generally C-shaped pill chamber, the pill chamber defined by a platform, a threaded outer chamber sidewall, an inner chamber sidewall, a pill cavity, and a longitudinal opening, the longitudinal opening comprising a tongue, wherein the crushing member is displaced into the pill cavity of the pill chamber by rotation of the threaded inner sidewall against the threaded outer chamber sidewall in a first direction parallel to the longitudinal opening, wherein the crushing member is displaced out of the pill cavity by rotation of the threaded inner sidewall against the threaded outer chamber sidewall in a second direction opposite the first direction;

a spoon, the spoon configured to slidably move along the longitudinal opening in the second direction for detachment from the pill chamber, the spoon defined by a head and an elongate handle, the head oriented generally towards the pill cavity, the handle oriented generally towards the outside of the pill cavity, the head comprising a brace, the brace configured to press against the inner chamber sidewall of the pill chamber, the handle comprising a pair of slots and a first fastening junction, the pair of slots configured to mate with the tongue of the longitudinal opening; and wherein the storage cavity defines a volume that may be selectably closed by the lid and which is adapted to contain a pill while closed.

2. The device of claim 1, wherein the storage portion has a general shape selected from the group consisting of octahedral, hexagonal, pentagonal, square, triangular and circular.

3. The device of claim 1, wherein the storage cavity has a general shape selected from the group consisting of spherical, parabolic or hyperbolic.

4. The device of claim 1, wherein the crushing member further comprises at least one protrusion to assist in crushing a tablet or pill disposed in the pill cavity.

5. The device of claim 1, wherein the outer sidewall is defined by a pattern of textures configured to enhance grip of the storage portion.

6. The device of claim 5, wherein the textures are selected from the group consisting of dimples, indentations, cross hatching, cross drilling and a roughened surface.

7. The device of claim 1, wherein the lid has a generally circular shape.

8. The device of claim 1, wherein the crushing member has a general shape selected from the group consisting of spherical, parabolic or hyperbolic.

9. The device of claim 1, wherein the first spoon is configured to receive a pill while in the pill cavity.

10. The device of claim 1, wherein the first spoon is configured to provide a supportive base for the pill while the pill is pulverized by the crushing member.

11. The device of claim 1, wherein the platform has a general shape selected from the group consisting of octahedral, hexagonal, pentagonal, square, triangular and circular.

12. The pill crushing device of claim 1, further comprising a primary axis; and wherein the wherein the lid attaches to the lid end of the storage portion by rotation of the threaded or slotted connector around the first axis;

wherein the lid detaches from the lid end of the storage portion by rotation of the threaded or slotted connector around the first axis;

wherein the longitudinal opening is a slot parallel to the first direction;

wherein the crushing member is displaced into the pill cavity of the pill chamber by rotation of the threaded inner sidewall against the threaded outer chamber sidewall around the first axis; and wherein the crushing member is displaced out of the pill cavity by rotation of the threaded inner sidewall around the first axis.

13. A pill crushing device comprising:

a storage portion, the storage portion defined by a lid end, a pulverizing end, a threaded inner sidewall, an outer sidewall, a threaded or slotted storage opening, and a storage cavity;

a lid, the lid defined by a panel, a threaded or slotted connector, and a lid handle;

wherein the lid attaches to the lid end of the storage portion by rotation of the threaded or slotted connector against the threaded or slotted storage opening in a first direction, wherein the lid detaches from the lid end of the storage portion by rotation of the threaded or slotted connector against the threaded or slotted storage opening in a second direction;

a crushing member, the crushing member disposed to protrude from the pulverizing end of the storage portion;

a generally C-shaped pill chamber, the pill chamber defined by a platform, a threaded outer chamber sidewall, an inner chamber sidewall, a pill cavity, and a longitudinal opening, the longitudinal opening comprising a tongue, wherein the crushing member is displaced into the pill cavity of the pill chamber by rotation of the threaded inner sidewall against the threaded outer chamber sidewall in a first direction, wherein the crushing member is displaced out of the pill cavity by rotation of the threaded inner sidewall against the threaded outer chamber sidewall in a second direction;

a spoon, the spoon configured to slidably move along the longitudinal opening for detachment from the pill chamber, the spoon defined by a head and an elongate handle, the head oriented generally towards the pill cavity, the handle oriented generally towards the outside of the pill cavity, the head comprising a brace, the brace configured to press against the inner chamber sidewall of the pill chamber, the handle comprising a pair of slots and a first fastening junction, the pair of slots configured to mate with the tongue of the longitudinal opening; and wherein the device further comprises a second spoon, the second spoon defined by a second head and an elongate second handle, the second handle terminating at a second fastening junction, the second fastening junction configured to detachably couple to the first fastening junction of the first handle.

14. The device of claim 13, wherein the second spoon is configured to receive a supplemental composition or food for adding to the pulverized pill.

* * * * *